US009316389B2

(12) United States Patent
Huang

(10) Patent No.: US 9,316,389 B2
(45) Date of Patent: Apr. 19, 2016

(54) MODULAR LED HEAT-DISSIPATING DEVICE

(71) Applicant: YUJING TECHNOLOGY CO., LTD., New Taipei (TW)

(72) Inventor: Cheng-Feng Huang, New Taipei (TW)

( * ) Notice: Subject to any disclaimer, the term of this patent is extended or adjusted under 35 U.S.C. 154(b) by 94 days.

(21) Appl. No.: 14/470,121

(22) Filed: Aug. 27, 2014

(65) Prior Publication Data

US 2016/0061434 A1 Mar. 3, 2016

(51) Int. Cl.

| | |
|---|---|
| ***F21V 29/00*** | (2015.01) |
| ***F21V 29/71*** | (2015.01) |
| ***F21V 23/00*** | (2015.01) |
| ***F21V 17/12*** | (2006.01) |
| *F21Y 101/02* | (2006.01) |

(52) U.S. Cl.
CPC ..... *F21V 29/713* (2015.01); *F21V 17/12* (2013.01); *F21V 23/002* (2013.01); *F21V 23/005* (2013.01); *F21Y 2101/02* (2013.01)

(58) Field of Classification Search
CPC ..... F21V 21/00; F21V 29/20; F21V 29/89; F21K 9/30; F21S 8/08
USPC ..... 362/294, 249.02
See application file for complete search history.

(56) References Cited

U.S. PATENT DOCUMENTS

| | | | | |
|---|---|---|---|---|
| 7,572,033 | B2 * | 8/2009 | Sun | F21V 29/004 257/722 |
| 7,591,575 | B2 * | 9/2009 | Hama | A61B 1/00096 362/231 |
| 8,132,947 | B2 * | 3/2012 | Shih | B60Q 1/0041 362/516 |
| 9,146,025 | B2 * | 9/2015 | Beausoleil | F21V 21/00 |
| 2007/0076422 | A1 * | 4/2007 | Nicolai | B60Q 1/0041 362/547 |
| 2010/0091507 | A1 * | 4/2010 | Li | F21V 7/09 362/470 |
| 2010/0134046 | A1 * | 6/2010 | Holder | F21V 19/001 315/297 |
| 2010/0141153 | A1 * | 6/2010 | Recker | H05B 33/0803 315/149 |
| 2010/0177519 | A1 * | 7/2010 | Schlitz | F04B 17/00 362/294 |
| 2013/0250598 | A1 * | 9/2013 | Lambert | B60Q 1/20 362/520 |

* cited by examiner

*Primary Examiner* — Ali Alavi

(74) *Attorney, Agent, or Firm* — Hershkovitz & Associates, PLLC; Abe Hershkovitz

(57) ABSTRACT

A modular LED heat-dissipating device includes an LED circuit board, a heat-conducting adhesive layer, a heat-dissipating structure, and a wire terminal module. The LED light source illuminates by power supplied via the wire terminal module. Heat generated from the LED light source is dissipated by the heat-dissipating structure. This device does not dissipate heat by a lamp housing. So the lamp housing can be made of, but not limited to, plastic, thereby decreasing a production cost of the LED lamp. In addition, the modular LED heat-dissipating device can fit various kinds of lamp housings. When the LED light source breaks down, the modular LED heat-dissipating device and the lamp housing can be easily separated to replace or repair the LED light source.

5 Claims, 5 Drawing Sheets

MODULAR LED HEAT-DISSIPATING DEVICE

BACKGROUND OF THE INVENTION

1. Field of the Invention

The present invention relates to a modular LED heat-dissipating device, and more particularly to a modular construction made by combining an LED board and a heat-dissipating apparatus.

2. Description of the Related Art

With reference to FIG. 4, a conventional LED lamp has an LED board 90, multiple LEDs 91, a thermally-conducting adhesive 100, and a light shell 110. The light shell 110 is made of metal. The LED board 90 has multiple LEDs 91 mounted on an inner surface of the light shell 110 by the thermally-conducting adhesive 100. Heat generated by the multiple LEDs 91 can be conducted to the metal light shell 110 by the thermally-conducting adhesive 100 immediately. Then the metal light shell 110 can further exchange heat with external air to dissipate heat and lower the temperature of the LED lamp.

With reference to FIG. 5, another conventional LED lamp has a first LED board 90A, a second LED board 90B, multiple first LEDs 91A, multiple second LEDs 91B, a first thermally-conducting adhesive 100A, a second thermally-conducting adhesive 100B, a third thermally-conducting adhesive 100C, a light shell 110, and a metal conductor 111. The metal conductor 111 is formed on an inner surface of the light shell 110 by the third thermally-conducting adhesive 100C. The first LED board 90A and the second LED board 90B are mounted on two opposite sides of the metal conductor 111 by the first thermally-conducting adhesive 100A and the second thermally-conducting adhesive 100B. Heat generated by the first LEDs 91A and the second LEDs 91B can be conducted to the metal conductor 111 through the first thermally-conducting adhesive 100A and the second thermally-conducting adhesive 100B. Then the heat can be further conducted to the light shell 110 by the third thermally-conducting adhesive 100C. Finally, the light shell 110 can exchange heat with external air to dissipate heat and lower the temperature of the LED lamp.

Heat generated by the LED light source can be conducted to the metal light shell and then exchanged with external air to dissipate heat for the above conventional LED lamps. Due to this heat-dissipating process, the light shell must be made of metal, which has heavy weight and increases a production cost of the LED lamps.

SUMMARY OF THE INVENTION

An objective of the present invention is to provide a modular LED heat-dissipating device that has advantages such as ease of disassembly and repair from the light shell for maintenance or enhancement of heat dissipation. Because the modular LED heat-dissipating device further has a heat-dissipating structure, the light shell is not necessarily made of metal and can be made of plastic, thereby decreasing the weight of the light shell and reducing the total production cost of the LED lamp. The low cost of the LED lamp can effectively promote wide-spread use of the LED lamp.

To achieve the foregoing objective, the modular LED heat-dissipating device comprises:

an LED circuit board having at least one LED light source;

a heat-conducting adhesive layer mounted on a side of the LED circuit board that is opposite to the at least one LED light source;

a heat-dissipating structure having multiple heat-dissipating fins and at least one fixing apparatus; wherein the heat-dissipating structure is mounted on a side of the heat-conducting adhesive layer that is opposite to the LED circuit board, and the multiple heat-dissipating fins extend toward the direction away from the heat-conducting adhesive layer; and the at least one fixing apparatus is disposed on a side of the heat-dissipating structure; and a wire terminal module having a wire terminal and multiple wires; the wire terminal module formed on one side of the heat-dissipating structure; the wire terminal connected to an external power, and the multiple wires electrically connected to the wire terminal and the LED circuit board.

The advantage of the present invention is using the multiple heat-dissipating fins of the heat-dissipating structure to dissipate heat from the at least one LED light source. Metal structure, such as a metal lamp housing, is not needed for heat dissipation. So the present invention can decrease a production cost of the LED lamp. In addition, the LED circuit board, the heat-conducting adhesive layer, the heat-dissipating structure, and the wire terminal module are preassembled and modularized into the LED heat-dissipating device of the present invention. As such, the user can fix the modular LED heat-dissipating device directly on a lamp housing. This modular device provides convenience for maintenance of the LED lamp.

Preferably, the LED circuit board, the heat-conducting adhesive layer, and the heat-dissipating structure each respectively have at least one penetration hole. The wires are electrically connected to the wire terminal and the LED circuit board via the penetration holes. The wires are mounted through the penetration holes to avoid disarray.

Preferably, the LED circuit board and the heat-conducting adhesive layer each respectively have at least one perforation; the heat-dissipating structure has at least one threaded hole corresponding to the perforations; the LED circuit board, the heat-conducting adhesive layer, and the heat-dissipating structure are combined together by screws fastened into the perforations and the at least one threaded hole. The connection among the LED circuit board, the heat-conducting adhesive layer, and the heat-dissipating structure is stabilized by fastening of the screws. Decreased thermal-conducting efficacy caused by deterioration of the heat-conducting adhesive layer can be avoided.

More preferably, two fixing apparatuses are mounted on two opposite sides of the heat-dissipating structure that are vertical to the extending direction of the multiple heat-dissipating fins; each fixing apparatus has one projecting ear, one fixing through hole, and one fixing screw; the projecting ear extends from the edge of the heat-dissipating structure, the fixing through hole is formed in the middle of the projecting ear and is vertical to the extending direction of the projecting ear; and the fixing screw is fastened into the fixing through hole and is selectively combined with an external equipment. Further, the external equipment is a lamp housing; the lamp housing has at least one opening corresponding to the modular LED heat-dissipating device and two fixing threaded holes corresponding to the two fixing screws. The modular LED heat-dissipating device is fixed on a lamp housing simply by fastening of screws and the LED light source is enclosed inside the lamp housing. As such, the present modular LED heat-dissipating device can fit various kinds of lamp housings, and can be easily assembled with or dissembled from the lamp housing.

DETAILED DESCRIPTION OF THE INVENTION

Figure 1:
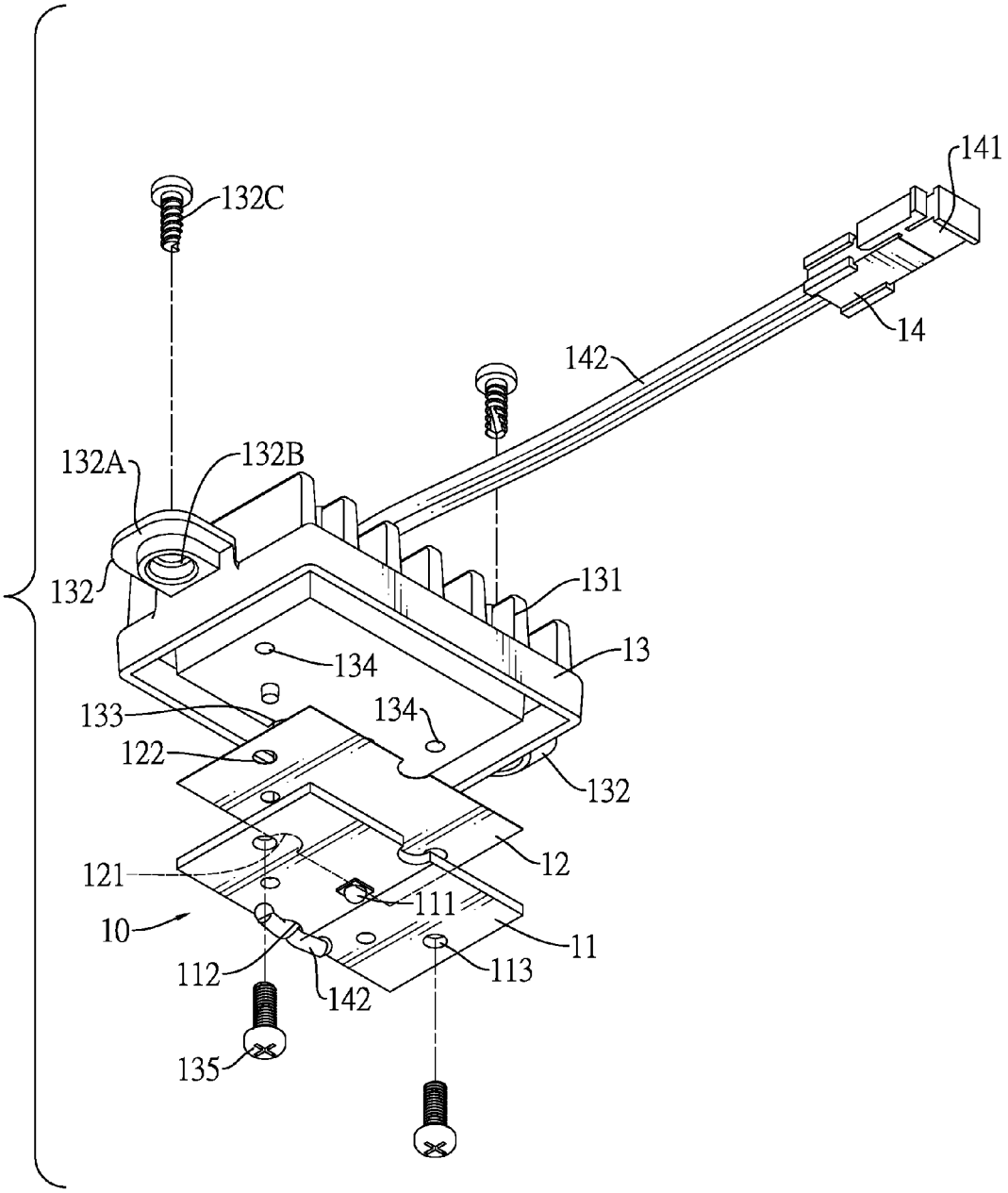
FIG. 1 is an exploded view of the modular LED heat-dissipating device in accordance with the present invention.

With reference to FIG. 1, a modular LED heat-dissipating device 10 of the present invention comprises an LED circuit board 11, a heat-conducting adhesive layer 12, a heat-dissipating structure 13, and a wire terminal module 14.

An LED light source 111 is mounted on the central point of one side of the LED circuit board 11.

The heat-conducting adhesive layer 12 is mounted on a side of the LED circuit board 11 that is opposite to the LED light source 111. The size and shape of the heat-conducting adhesive layer 12 match with the LED circuit board 11.

The heat-dissipating structure 13 is mounted on a side of the heat-conducting adhesive layer 12 that is opposite to the LED circuit board 11. The heat-dissipating structure 13 has multiple heat-dissipating fins 131 and two fixing apparatuses 132. The heat-dissipating fins 131 extend toward a direction away from the heat-conducting adhesive layer 12. The heat-dissipating fins are mounted upright side by side at intervals. The two fixing apparatuses 132 are mounted on two opposite sides of the heat-dissipating structure 13 that are vertical to the extending direction of the multiple heat-dissipating fins 131. Each fixing apparatus 132 has a projecting ear 132A, a fixing through hole 132B, and a fixing screw 132C. The projecting ear 132A extends from an edge of the heat-dissipating structure 13, the fixing through hole 132B is formed in the middle of the projecting ear 132A, and the fixing through hole 132B is vertical to the extending direction of the projecting ear 132A; the fixing screw 132C is fastened into the fixing through hole 132B and may be selectively combined with an external equipment.

The wire terminal module 14 is formed on a side of the heat-dissipating structure 13 that is opposite to the heat-conducting adhesive layer 12. The wire terminal module 14 has a wire terminal 141 and two wires 142 (an anode wire and a cathode wire). The wire terminal 141 is selectively connected to an external power source, and the wires 142 are electrically connected to the wire terminal 141 and the LED circuit board 11.

The LED circuit board 11, the heat-conducting adhesive layer 12, and the heat-dissipating structure 13 each respectively have at least one penetration hole 112,121,133. The wires 142 are electrically connected to the wire terminal 141 and the LED circuit board 11 via the penetration hole 133 of the heat-dissipating structure 13, the penetration hole 121 of the heat-conducting adhesive layer 12, and the penetration hole 112 of the LED circuit board 11. Then the LED light source 111 is illuminated by power from the external power source.

The LED circuit board 11 and the heat-conducting adhesive layer 12 each respectively have two corresponding perforations 113,122, and the heat-dissipating structure 13 has two threaded holes 134 corresponding to the perforations 113 of the LED circuit board 11 and the perforations 122 of the heat-conducting adhesive layer 12. The LED circuit board 11, the heat-conducting adhesive layer 12, and the heat-dissipating structure 13 are combined together by screws 135 fastened into the perforations 113 of the LED circuit board 11, the perforations 122 of the heat-conducting adhesive layer 12, and the threaded holes 134. The LED circuit board 11, the heat-conducting adhesive layer 12, and the heat-dissipating structure 13 can be firmly combined.

Figure 2:
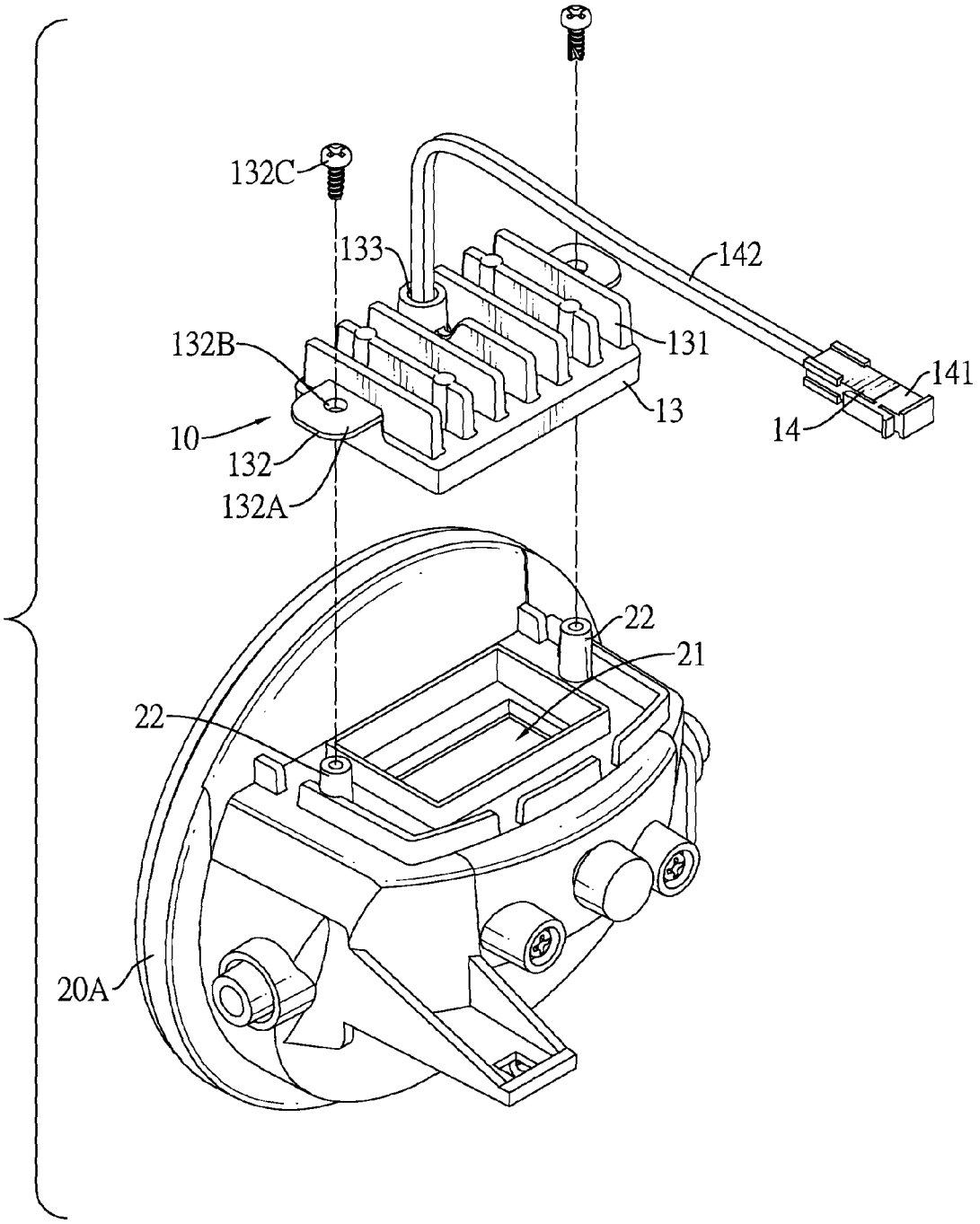
FIG. 2 is a schematic view of an embodiment of the modular LED heat-dissipating device in accordance with the present invention.

With reference to FIGS. 1 and 2, the external equipment is a semicircular lamp housing 20A. The semicircular lamp housing 20A has an opening 21 formed on a top side of the lamp housing heat-dissipating 10 and two fixing threaded holes 22 corresponding to the fixing screws 132C. Fix the fixing apparatus 132 can be fixed on the opening 21 by the fixing screws 132C. The LED circuit board 11 and the heat-conducting adhesive layer 12 are enclosed inside the semicircular lamp housing 20A. When the LED light source 111 is illuminated, light is reflected by the semicircular structure and penetrates through the external part of the lamp housing.

Figure 3:
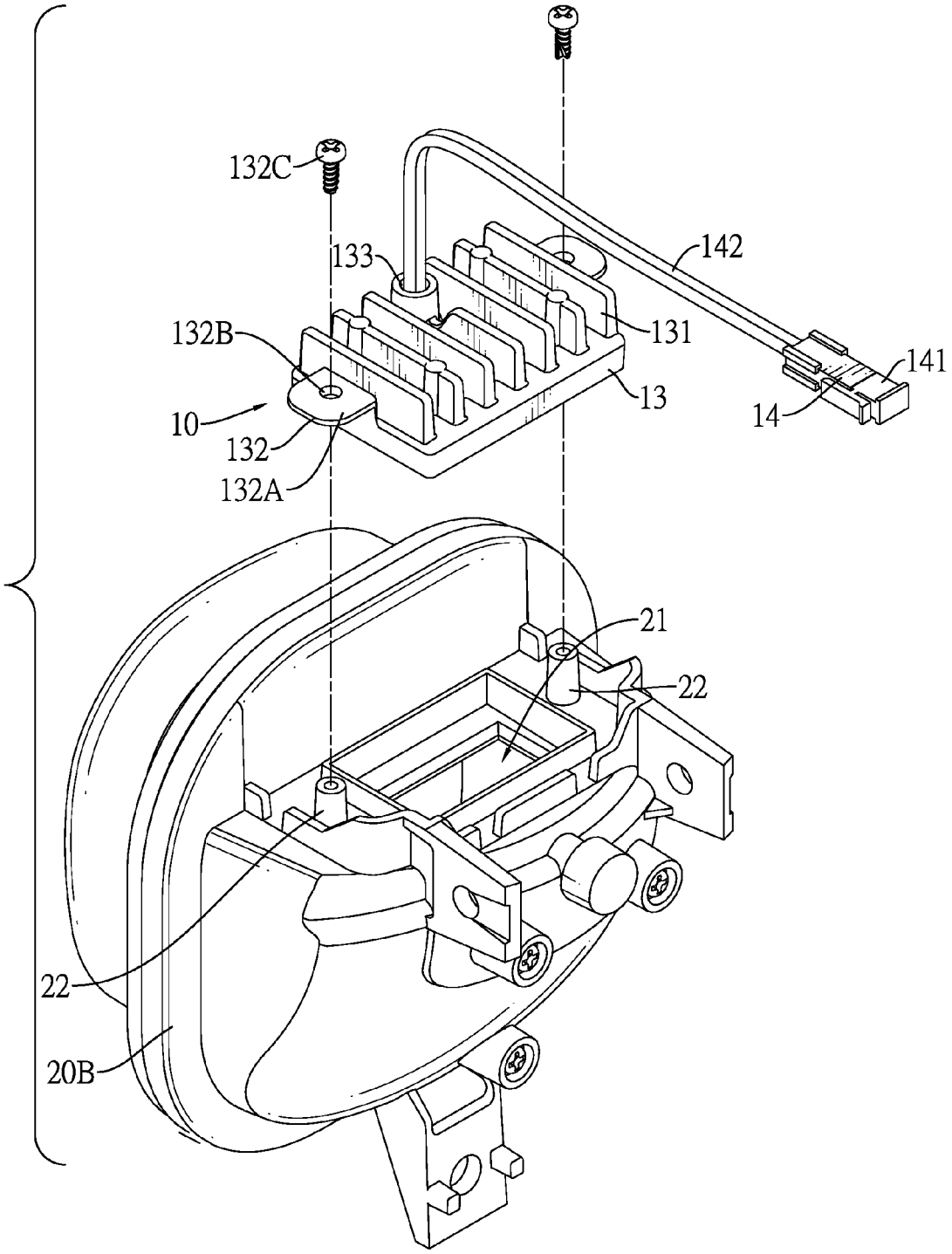
FIG. 3 is a schematic view of another embodiment of the modular LED heat-dissipating device in accordance with the present invention.
Figure 4:
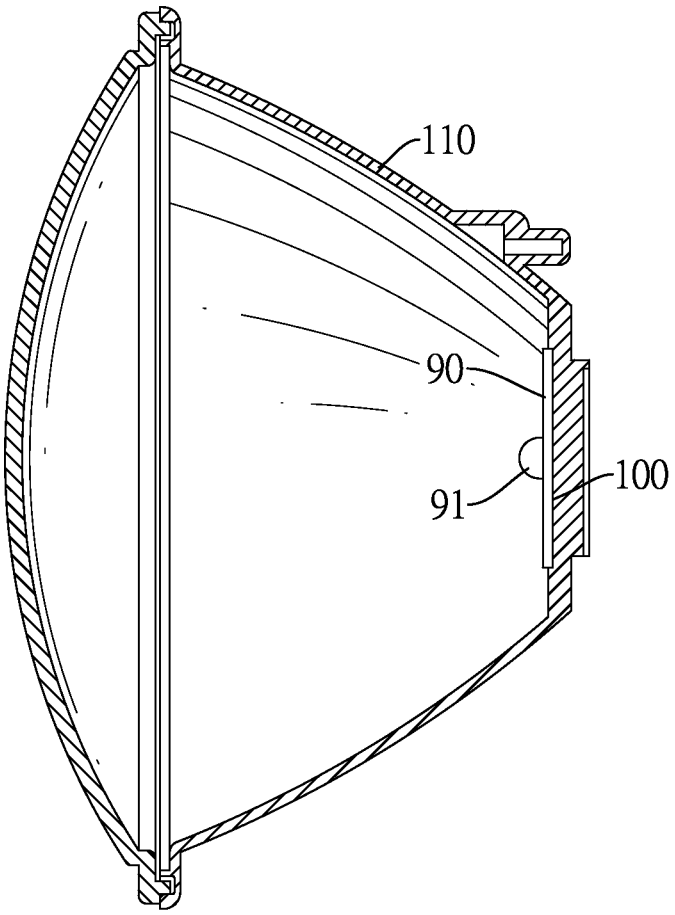
FIG. 4 is a side view of a conventional LED lamp.
Figure 5:
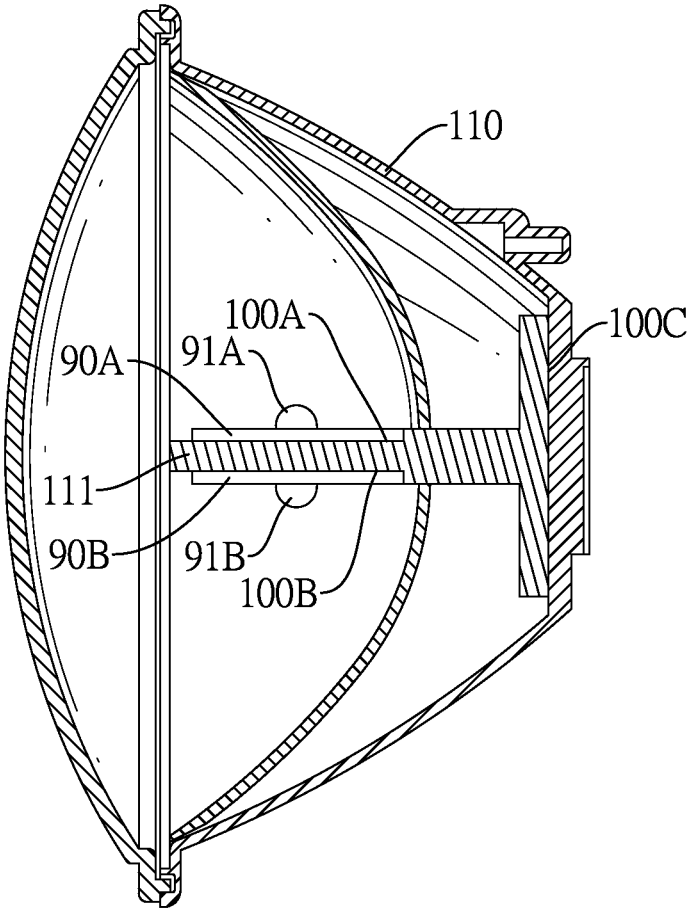
FIG. 5 is a side view of another conventional LED lamp.

With reference to FIGS. 1 and 3, the semicircular lamp housing 20A can be replaced by a cuboid lamp housing 20B. The cuboid lamp housing 20B also has an opening 21 on a top side of the cuboid lamp housing 20B and two fixing threaded holes 22 corresponding to the above fixing screws 132C. The fixing apparatus 132 of the present modular LED heat-dissipating device 10 can be fixed on the opening 21 by the fixing screws 132C. The LED circuit board 11 and the heat-conducting adhesive layer 12 are enclosed inside the cuboid lamp housing 20B. When the LED light source 111 is illuminated, light is reflected by the cuboid structure and penetrates through the external part of the lamp housing.

In summary, the LED circuit board 11, the heat-conducting adhesive layer 12, the heat-dissipating structure 13, and the wire terminal module 14 are preassembled and modularized into the modular LED heat-dissipating device 10. A user can fix the modular LED heat-dissipating device 10 on a lamp housing. When the LED light source 111 breaks down, the user can simply separate the modular LED heat-dissipating device 10 and the lamp housing to repair or replace the LED light source 111.

In addition, the present modular LED heat-dissipating device 10 mainly utilizes the heat-dissipating fins 131 of the heat-dissipating structure 13 to dissipate heat from the LED light source 111. As heat is not conducted and dissipated via the lamp housing, the lamp housing is not necessarily made of metal. As such, weight of the lamp housing can be reduced. More importantly, production cost of the LED lamps can also be decreased. The present invention can effectively provide a convenient, practical and inexpensive LED lamp.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A modular light emitting diode (LED) heat-dissipating device comprising:

an LED circuit board having at least one LED light source;

a heat-conducting adhesive layer mounted on a side of the LED circuit board that is opposite to the at least one LED light source;

a heat-dissipating structure having multiple heat-dissipating fins and at least one fixing apparatus; wherein the heat-dissipating structure is mounted on a side of the heat-conducting adhesive layer that is opposite to the LED circuit board, and the multiple heat-dissipating fins extend toward a direction away from the heat-conducting adhesive layer; and the at least one fixing apparatus is disposed on a side of the heat-dissipating structure; and a wire terminal module having a wire terminal and multiple wires; the wire terminal module formed on one side of the heat-dissipating structure; the wire terminal connected to an external power source, and the multiple wires electrically connected to the wire terminal and the LED circuit board.

2. The device as claimed in claim 1, wherein the LED circuit board, the heat-conducting adhesive layer and the heat-dissipating structure each respectively have at least one penetration hole, and the wires are electrically connected to the wire terminal and the LED circuit board via the penetration holes.

3. The device as claimed in claim 1, wherein the LED circuit board and the heat-conducting adhesive layer each respectively have at least one perforation; the heat-dissipating structure has at least one threaded hole corresponding to the perforations; the LED circuit board, the heat-conducting adhesive layer and the heat-dissipating structure are combined together by screws fastened into the perforations and the at least one threaded hole.

4. The device as claimed in claim 1, wherein two fixing apparatuses are mounted on two opposite sides of the heat-dissipating structure that are vertical to the extending direction of the multiple heat-dissipating fins; each fixing apparatus has one projecting ear, one fixing through hole and one fixing screw; the projecting ear extends from edge of the heat-dissipating structure, the fixing through hole is formed in the middle of the projecting ear and is vertical to extending direction of the projecting ear; and the fixing screw is fastened into the fixing through hole and is selectively combined with an external equipment.

5. The device as claimed in claim 4, wherein the external equipment is a lamp housing; the lamp housing has at least one opening corresponding to the modular LED heat-dissipating device and two fixing threaded holes corresponding to the two fixing screws.

* * * * *